US005332197A

United States Patent [19]

Benz et al.

[11] Patent Number: 5,332,197

[45] Date of Patent: * Jul. 26, 1994

[54] ELECTROSLAG REFINING OR TITANIUM TO ACHIEVE LOW NITROGEN

[75] Inventors: Mark G. Benz, Burnt Hills; Thomas F. Sawyer, Stillwater, both of N.Y.

[73] Assignee: General Electric Company, Schenectady, N.Y.

[ * ] Notice: The portion of the term of this patent subsequent to Nov. 3, 2009 has been disclaimed.

[21] Appl. No.: 969,900

[22] Filed: Nov. 2, 1992

[51] Int. Cl.[5] ..... C21C 1/00

[52] U.S. Cl. ..... 266/201; 266/202; 222/603

[58] Field of Search ..... 266/201, 202; 222/594, 222/603

[56] References Cited

U.S. PATENT DOCUMENTS

| | | | |
|---|---|---|---|
| 3,826,301 | 7/1974 | Brooks | 164/46 |
| 3,909,921 | 10/1975 | Brooks | 29/527.2 |
| 4,726,840 | 2/1988 | Choudhury et al. | 75/10.24 |
| 4,779,802 | 10/1988 | Coombs | 239/292 |
| 4,926,923 | 5/1990 | Brooks et al. | 164/5 |
| 5,004,153 | 4/1991 | Sawyer | 239/81 |
| 5,160,532 | 11/1992 | Benz et al. | 266/202 |

OTHER PUBLICATIONS

D. J. Chronister, S. W. Scott, D. R. Stickle, D. Eylon, F. H. Froes, "Induction of Skull Melting of Titanium and Other Reactive Alloys," Journal of Metals, Sep. 1986, pp. 51-54.

O. V. Tarlov, A. P. Maksimov, V. I. Padchenko, "About the Oxygen Behaviour in Titanium Electroslag Remelting", Donetsk Polytechnical Institute, Advances in Special Electrometalurgy (USSR) 7, (2), 95-98 Apr.-Jun. 1991.

A. Mitchell, "The Production of High-Quality Materials by Special Melting Processes", J. Vac. Sci. Technol. A 5, (4-IV), 2672-2677 Jul.-Aug. 1987.

H. Jaeger, R. Tarmann, R. Froehlich, J. Baumgartner, "New Production Routes for Vacuum Melted Aerospace Materials", Iron and Steel Institute of Japan, Keidanren Kaikan, Otemachi 1-9-4, Chiyoda-ku, Tokoyo 100, Japan, 1982.

E. L. Morosov, A. D. Tchutchurukin, "Electroslag Remelting of Titanium Ingots", Plenum Press, 233 Spring St., New Yori, N.Y. 10013, 1982, 161-167.

E. L. Morozov, M. I. Musatov, A. D. Churchuryukin, S. H. Fridman, "Investigation of Various Methods of Melting and Casting of Titanium Alloys", TMS/AIME, P.O. Box 430, 420 Commonwealth Dr., Warrendale, Pa., 15086, 1980.

R. A. Beall, P. G. Clites, J. T. Dunham, R. H. Nafziger, "Titanium Melting by the Electroslag Process Final Summary Report, Jun. 1965-Sep. 1968 (Titanium Melting by Electroslag Process)", Report No.: AD-697723; USBM-RC-1351.

(List continued on next page.)

*Primary Examiner*—George Wyszomierski

*Attorney, Agent, or Firm*—Edward P. Anderson; James Magee, Jr.

[57] ABSTRACT

A method for the electroslag refining of titanium base alloy is provided. The method involves providing a refining vessel to contain an electroslag refining layer floating on a layer of molten refined metal. An ingot of unrefined titanium base alloy having a higher nitrogen content is lowered into the vessel into contact with the molten electroslag layer. A refining current is passed through the slag layer to the ingot to cause surface melting at the interface between the ingot and the electroslag layer. As the ingot is surface melted at its point of contact with the slag, droplets of the unrefined metal are formed and these droplets are refined as they pass down through the slag and are collected in a body of molten refined metal beneath the slag. The refined metal is held within a cold hearth. At the bottom of the cold hearth, a cold finger orifice is provided to permit the withdrawal of refined metal from the cold hearth apparatus. The refined metal passes from the cold finger orifice as a stream and may be processed into a sound metal structure having low nitrogen content and desired grain structure.

16 Claims, 5 Drawing Sheets

OTHER PUBLICATIONS

R. A. Beall, P. G. Clites, "Large-Scale Electroslag Melting of Ti", The Electroslag Melting Process Bull. 669, U.S. Bureau of Mines, 1976, 97-108.

V. Z. Kutsova, D. E. Belokurov, "Reprocessing Titanium Production Wastes by Electroslag Remelting with Nonexpandable Electrode", Liteinoe Proizvodstov n Apr. 4 1991 pp. 18-19, 1991.

H. B. Bomberger, F. H. Froes, "Melting of Titanium", Journal of Metals v 36 n 12 Cec. 1984 pp. 39-47.

C. E. Armantrout, R. A. Beall, J. T. Dunham, "Properties of Wrought Shapes Formed from Electroslag-Melted Titanium", Metallurgical Society of AIME, and American Society for Metals, International Conference on Titanium, London, England, May 21-24, 1968, Proceedings. P. 67-74./A70-34351 17-17/.

V. N. Radchenko, O. V. Tarlov, A. P. Maksimov, "Oxygen Behavior in Electroslag Remelting of Titanium", Probl. Spets. Elektrometall., 1991.

V. Z. Kutsova, D. E. Belokurov, "Processing of Titanium Industry Wastes by Electroslag Remelting with Nonconsumable Electrode", Journal: Liteinoe Proizvod., 1991 pp. 18-19.

V. N. Zamkov, T. M. Shpak, N. G. Zaitseva, Yu. K. Novikov, "Electroslag Remelting of Complex Titanium Alloys", Probl. Metallurg. Pr-va, Kiev, 1990, pp. 87-89.

Vaclav Klabik, Vaclav Landa, Miroslav Cadil, "Ingot Manufacture from Superconductive Niobium-Titanium Alloy", Czechoslovakia; CS 252053 B1, Date Jun. 25, 1988.

Toshio Onoe, Tatsuhiko Sodo, Seiji Nishi, "Fluxes for Electroslag Remelting", JP 86288025 A2; JP 61288025, Date: Dec. 18, 1986.

"Electroslag Remelting of Titanium—in Protective Atmosphere" U.S. Patent 3,989,091, issued Nov. 2, 1976.

V. E. Roshchin, D. Ya Povolotskii, P. P. Biryukov, "Behavior of Nitrogen and Nitride Inclusions in Electroslag Remelting of Titanium-Bearing Steel", Steel USSR 10, (2), 80-81 Feb. 1980.

ELECTROSLAG REFINING OR TITANIUM TO ACHIEVE LOW NITROGEN

This invention is subject to a Terminal Disclaimer disclaiming that portion of the patent which would extend beyond the expiration date of U.S. Pat. No. 5,160,532, issued Nov. 3, 1992.

BACKGROUND OF THE INVENTION

The present invention relates generally to electroslag processing of titanium base alloys to achieve low nitrogen concentrations. More specifically, it relates to carrying out the electroslag refining of titanium base alloys so as to reduce the concentration of nitrogen below that which is conventionally present.

It is known that the processing relatively large bodies of metal, such as superalloys and titanium alloys, is accompanied by many problems which derive from the bulky volume of the body of metal itself. Such processing involves problems of sequential heating and forming and cooling and reheating of the large bodies of the order of 5,000 to 35,000 pounds or more in order to control grain size, other microstructure and other properties. Such problems also involve segregation of the ingredients of alloys in large metal bodies as processing by melting and similar operations is carried out. A sequence of processing operations is sometimes selected in order to overcome the difficulties which arise through the use of bulk processing and refining operations.

One such sequence of steps involves a sequence of vacuum induction melting followed by electroslag refining and followed, in turn, by vacuum arc refining and followed, again in turn, by mechanical working through forging and drawing types of operations. While the metal produced by such a sequence of steps is highly useful and the metal product itself is quite valuable, the processing through the several steps is expensive and time-consuming.

For example, the vacuum induction melting of scrap metal into a large body of metal of 20,000 to 35,000 pounds or more can be very useful in recovery of the scrap material. The scrap may be combined with virgin metal to achieve a nominal alloy composition desired and also to render the processing economically sound. The size range is important for scrap remelting economics. According to this process, the scrap and other metal is processed through the vacuum induction melting steps so that a large ingot is formed and this ingot has considerably more value than the scrap and other material used in forming the ingot. Following this conventional processing, the large ingot product is usually found to contain one or more of three types of defects and specifically voids, slag inclusions and macrosegregation.

This recovery of scrap into an ingot is the first step in a refining process which involves several sequential processing steps. Some of these steps are included in the subsequent processing specifically to cure the defects generated during the prior processing. For example, such a large ingot may then be processed through an electroslag refining step to remove a significant portion of the oxide and sulfide which may be present in the ingot as a result of the ingot being formed at least in part from scrap material.

Electroslag refining is a well-known process which has been used industrially for a number of years. Such a process is described, for example, on pages 82–84 of a text on metal processing entitled "Superalloys, Supercomposites, and Superceramics". This book is edited by John K. Tien and Thomas Caulfield and is published by Academic Press, Inc. of Harcourt Brace Jovanovich, and bears the copyright of 1989. The use of this electroslag refining process is responsible for removal of oxide, sulfide and other impurities from the vacuum induction melted ingot so that the product of the processing has lower concentrations of these impurities. The product of the electroslag refining is also largely free of voids and slag inclusions.

However, a problem arises in the electroslag refining process because of the formation of a relatively deep melt pool as the process is carried out. The deep melt pool results in a degree of ingredient macrosegregation and in a less desirable microstructure. Defects produced by macrosegregation are visually apparent and are called "freckles". One way to reduce freckles is by reducing the diameter of the formed ingot but such reduction can also adversely affect economics of the processing.

To overcome this deep melt pool problem, a subsequent processing operation is employed in combination with the electroslag refining, particularly to reduce the depth of the melt pool and the segregation and microstructure problems which result from the deeper pool. This latter processing is a vacuum arc refining and it is also carried out by a conventional and well-known processing technique.

The vacuum arc refining starts with the ingot produced by the electroslag refining and processes the metal through the vacuum arc steps to produce a relatively shallow melt pool and to produce better microstructure, and possibly a lower nitrogen content, as a result. Again, for reasons of economic processing, a relatively large ingot of the order of 10 to 40 tons is processed through the electroslag refining and then through the vacuum arc refining. However, the large ingots of this processing has a large grain size and may contain defects called "dirty" white spots.

Following the vacuum arc refining, the ingot of this processing is then mechanically worked to yield a metal stock which has better microstructure. Such a mechanical working may, for example, involve a combination of steps of forging and drawing to lead to a relatively smaller grain size. The thermomechanical processing of such a large ingot requires a large space on a factory floor and requires large and expensive equipment as well as large and costly energy input.

The conventional processing as described immediately above has been found necessary over a period of time in order to achieve the very desirable microstructure in the metal product of the processing. As is indicated above in describing the background of this art, one of the problems is that a first processing step results in some deficiency in the product of that step so that another, and second processing step is combined with the first in order to overcome the deficiency of the initial or earlier step in the processing. However, when the necessary combination of steps is employed, a successful and beneficial product with a desirable microstructure is produced. The drawback of the use of this recited combination of processing steps is that very extensive and expensive equipment is needed in order to carry out the sequence of processing steps and further a great deal of processing time and heating and cooling energy is employed in order to carry out each of the processing steps and to go from one step to the next step of the sequence as set forth above.

The processing as described above has been employed in the application of superalloys such as IN-718 and René 95. For some alloys the sequence of steps has led to successful production of alloy billets, the composition and crystal structure of which are within specifications so that the alloys can be used as produced. For other superalloys, and specifically for the René 95 alloy, it is usual for metal processors to complete the sequence of operations leading to specification material by adding the processing of large ingot products of the processing through powder metallurgy techniques. Where such powder metallurgical techniques were employed, the first steps in completing the sequence are the melting of the large alloy ingot and gas atomization of the melt by conventional remotely coupled atomization techniques. This is followed by screening the powder which is produced by the atomization. The selected fraction of the screened powder is then conventionally enclosed within a can of soft steel, for example, and the can is HIPed to consolidate the powder into a useful form. Such HIPing may be followed by extruding or other conventional processing steps to bring the consolidated product to a useable form.

An alternative to the powder metallurgy processing as described immediately above is an alternative conventional process known as spray forming. Spray forming has been described in a number of patents including the U.S. Pat. Nos. 3,909,921; 3,826,301; 4,926,923; 4,779,802; 5,004,153; as well as a number of other such patents.

In general, the spray forming process has been gaining additional industrial use as improvements have been made in such processing, particularly because it involves fewer steps and has a cost advantage over conventional powder metallurgy techniques so there is a tendency toward the use of the spray forming process where it yields products which are comparable and competitive with the products of the conventional powder metallurgy processing.

It has been recognized that in the processing of titanium base alloys a great deal of technology has been developed over a period of time in the electroslag refining of the titanium base alloys. Among the literature references which relate to the electroslag refining of titanium based alloys is the following:

(1) OV Tarlov, AP Maksimov, VI Padchenko, "About the Oxygen Behaviour in Titanium Electroslag Remelting", Donetsk Polytechnical Institute, Advances in Special Electrometalurgy (USSR) 7, (2), 95-98 Apr.-Jun. 1991.

(2) A. Mitchell, "The Production of High-Quality Materials by Special Melting Processes", J. Vac. Sci. Technol. A 5, (4-IV), 2672-2677 Jul.-Aug. 1987.

(3) H. Jaeger, R. Tarmann, R. Froehlich, J. Baumgartner, "New Production Routes for Vacuum Melted Aerospace Materials", Iron and Steel Institute of Japan, Keidanren Kaikan, Otemachi 1-9-4, Chiyodaku, Tokoyo 100, Japan, 1982 .

(4) EL Morosov, AD Tchutchurukin, "Electroslag Remelting of Titanium Ingots", Plenum Press, 233 Spring St., New York, N.Y. 10013, 1982, 161-167.

(5) EI Morozov, MI Musatov, AD Churchuryukin, Sh Fridman, "Investigation of Various Methods of Melting and Casting of Titanium Alloys", TMS/AIME, P.O. Box 430, 420 Commonwealth Dr., Warrendale, Pa., 15086, 1980 .

(6) RA Beall, PG Clites, "Large-Scale Electroslag Melting of Ti", The Electroslag Melting Process Bull. 669, U.S. Bureau of Mines, 1976, 97-108.

(7) VZ Kutsova, DE Belokurov, "Reprocessing Titanium Production Wastes by Electroslag Remelting with Nonexpandable Electrode", Liteinoe Proizvodstov n Apr. 4, 1991 p. 18-19, 1991.

(8) HB Bornberger, FH Froes, "Melting of Titanium", Journal of Metals v 36 n 12 Cec. 1984 p. 39-47.

(9) RA Beall, PG Clites, JT Dunham, RH Nafziger, "Titanium Melting by the Electroslag Process Final Summary Report, Jun. 1965-Sep. 1968 (Titanium Melting by Electroslag Process)", Report No.: AD-697723; USBM-RC-1351.

(10) CE Armantrout, RA Beall, JT Dunham, "Properties of Wrought Shapes Formed from Electroslag-Melted Titanium", Metallurgical Society of AIME, and American Society for Metals, International Conference on Titanium, London, England, May 21-24, 1968, Proceedings. P. 67-74 ./A70-34351 17-17/.

(11) VN Radchenko, OV Tarlov, AP Maksimov, "Oxygen Behavior in Electroslag Remelting of Titanium", Probl. Spets. Elektrometall., 1991.

(12) VZ Kutsova, DE Belokurov, "Processing of Titanium Industry Wastes by Electroslag Remelting with Nonconsumable Electrode", Journal: Liteinoe Proizvod., 1991 pp. 18-19.

(13) VN Zamkov, TM Shpak, NG Zaitseva, Yu.K Novikov, "Electroslag Remelting of Complex Titanium Alloys", Probl. Metallurg. Pr-va, Kiev, 1990, pp. 87-9.

(14) Vaclav Klabik, Vaclav Landa, Miroslav Cadil, "Ingot Manufacture from Superconductive Niobium-Titanium Alloy", Czechoslovakia; CS 252053 B1, Date: 880625.

(15) Toshio Onoe, Tatsuhiko Sodo, Seiji Nishi, "Fluxes for Electroslag Remelting", JP 86288025 A2; JP 61288025, Date: 861218.

(16) "Electroslag Remelting of Titanium - in Protective Atmosphere38 U.S. Pat. No. 3,989,091, issued Nov. 2, 1976. The U.S. Pat. No. 3,989,091 discloses what appears to be the use of an inert gas in connection with an apparent continuous casting of a titanium ingot coupled with electroslag remelting within a "cooled mould".

(17) VE Roshchin, D Ya Povolotskii, PP Biryukov, "Behavior of Nitrogen and Nitride Inclusions in Electroslag Remelting of Titanium-Bearing Steel", Steel USSR 10, (2), 80-81 Feb. 1980.

In all of the literature concerning the electroslag refining of titanium based alloys there is no description of the effect of nitrogen on the properties of the titanium based alloys. I have found that it is highly desirable to reduce the concentration of nitrogen in the titanium based alloys so as to enhance the properties of the titanium based alloys. In particular, I have found that it is desirable to reduce the nitrogen content of alloys of titanium which are prepared by electroslag refining.

BRIEF STATEMENT OF THE INVENTION

In one of its broader aspects, objects of the invention can be achieved by providing a titanium base electrode with above specification nitrogen chemistry, introducing the electrode into an electroslag refining vessel containing molten slag to electrically contact the slag in said vessel, providing a low nitrogen inert gas atmosphere above the molten slag and about the end of said electrode in contact with said slag, passing a high electric current through the electrode and slag to cause the electrode to resistance melt at the surface where it contacts the slag and to cause droplets of electrode formed from such melting to pass down through the slag and to be refined as they pass through the slag, collecting the descending molten metal in a cold hearth positioned beneath the electroslag refining vessel, providing a cold finger bottom pour spout at the bottom of the cold hearth apparatus to permit liquid to pass through the spout as a stream, and forming the stream into a titanium base article of specification low nitrogen chemistry.

The present invention in another of its broader aspects may be accomplished by an apparatus for producing low nitrogen refined metal alloy which comprises electroslag refining apparatus comprising a metal refining vessel adapted to receive and to hold a molten slag adapted to electroslag refine a titanium base alloy, means for positioning a titanium base electrode in said vessel in touching contact with said molten slag, means for maintaining a low partial pressure of nitrogen above said molten slag and in contact with the portion of said electrode in contact with said slag, electric supply means adapted to supply refining current to said electrode and through said molten slag to the metal refining vessel and to keep said refining slag molten, means for advancing said electrode toward said molten slag at a rate corresponding to the rate at which the electrode is consumed as the refining thereof proceeds, and a cold hearth beneath said metal refining vessel, said cold hearth being adapted to receive and to hold electroslag refined molten titanium base alloy in contact with a solid skull of said refined metal in contact with said cold hearth, and a cold finger orifice below said cold hearth adapted to receive and to dispense as a stream low nitrogen molten titanium base alloy processed through said electroslag refining process and through said cold hearth

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
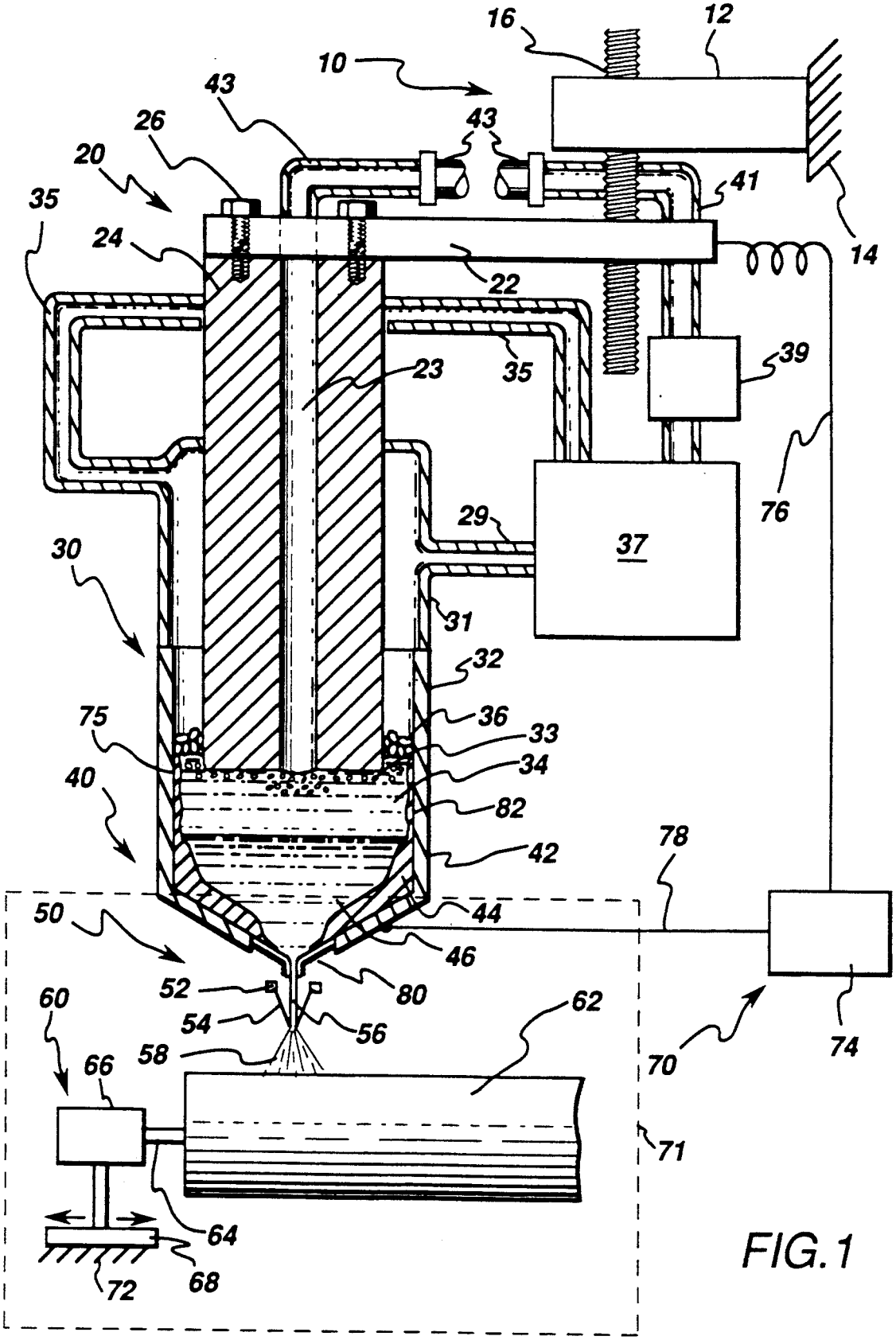
FIG. 1 is a semischematic vertical sectional view of an apparatus suitable for carrying out the present invention.

The method of the present invention is carried out by introducing an ingot electrode of titanium base alloy having a higher nitrogen content to be refined directly into an electroslag refining apparatus and refining the metal to produce a melt of refined metal which is received and retained within a cold hearth apparatus mounted immediately below the electroslag refining apparatus. The refined molten alloy has a lower nitrogen content and is dispensed from the cold hearth through a cold finger orifice mounted directly below the cold hearth reservoir.

If the rate of electroslag refining of source alloy and accordingly the rate of delivery of refined alloy to a cold hearth approximates the rate at which refined molten alloy is drained from the cold hearth through the cold finger orifice, an essentially steady state operation is accomplished in the overall apparatus and the process can operate continuously for an extended period of time and, accordingly, can process a large bulk of titanium base alloy.

Once the metal is drained from the cold hearth through the cold finger orifice, it may be further processed to produce a relatively large ingot of refined metal or it may be processed through alternative processing steps to produce smaller articles or continuous cast articles such as strip or rod or similar metallurgical products. A very important aspect of the invention is that it effectively eliminates many of the processing operations such as those described in the background statement above which, until now, have been necessary in order to produce a metal product having a desired set of properties. For example, the prior art U.S. Pat. No. 3,989,091 produces a large ingot as is evident from the figure of this patent.

The processing described herein is applicable to a wide range of titanium alloys which can be processed beneficially through the electroslag refining processing. Such alloys include alpha and gamma titanium-based alloys, among others. The slag used in connection with such metals will vary with the metal being processed and will usually be a slag containing calcium fluoride or similar fluoride conventionally used with a particular titanium base metal in the conventional electroslag refining thereof.

One of the several processing techniques which may be combined with the apparatus as described immediately above is a spray-forming operation. Such spray forming may be employed to form conventional spray-formed products or it may be employed to form relatively large objects because the ingot which can be processed through the combined electroslag refining and cold hearth and cold finger mechanism can be a relatively large supply ingot and can, accordingly, produce a continuous stream of metal exiting from the cold finger orifice over a prolonged period to deliver a large volume of molten metal.

An illustrative apparatus is described below with particular reference to the processing through a spray-forming operation although it will be understood that the combination of electroslag refining taken together with the cold hearth retention and the cold finger draining of the cold hearth is a novel apparatus and process by itself and can be operated without the use of the spray forming. In fact, this combination of apparatus components and process steps may be operated with a variety of other processing alternative apparatus and methods, such as continuous casting, as has been outlined briefly above.

Figure 2:
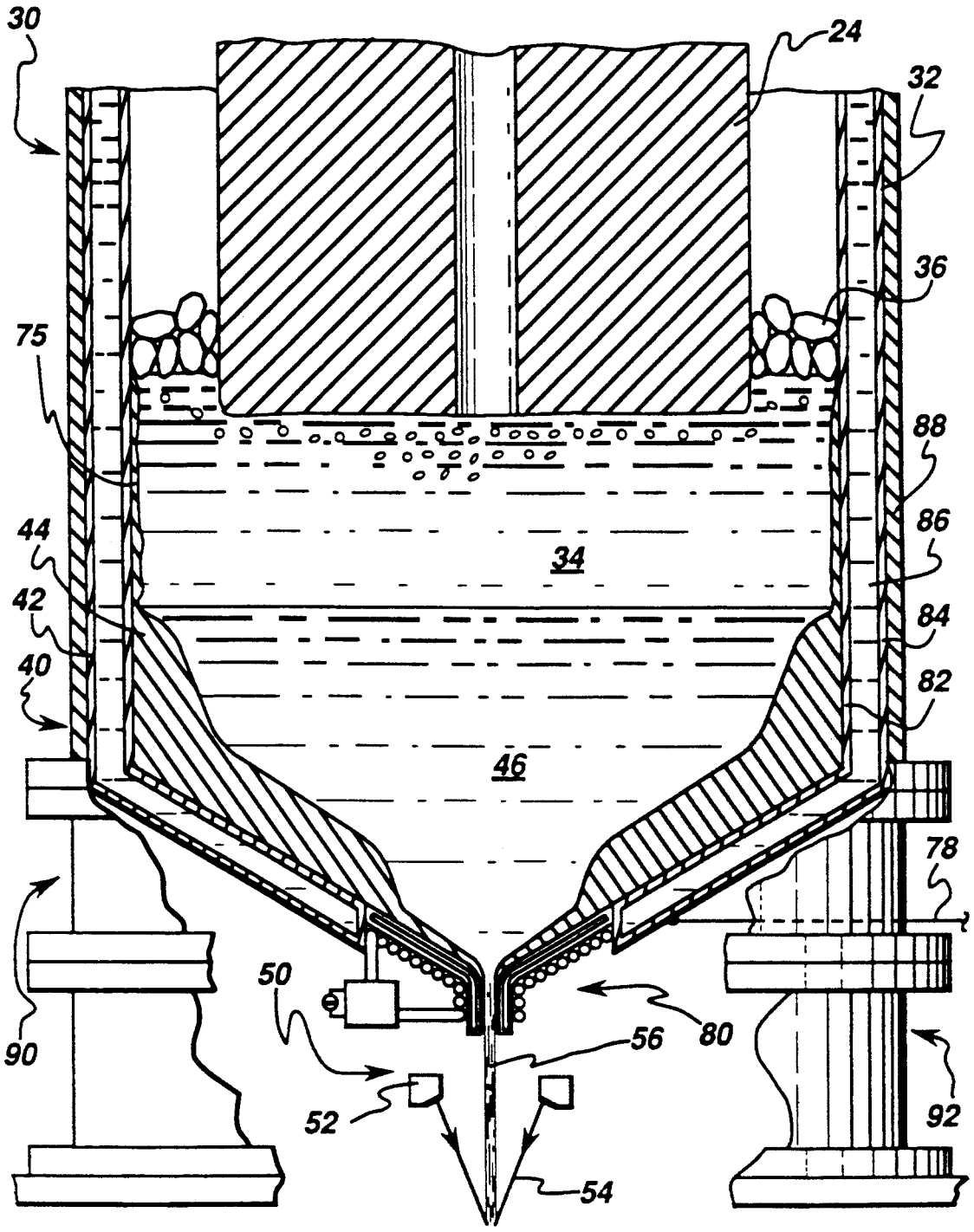
FIG. 2 is a semischematic vertical sectional illustration of part of an apparatus such as that illustrated in FIG. 1 but showing more structural detail of the electroslag refining portion than is presented in FIG. 1.

Referring now particularly to the accompanying drawings, FIG. 1 is a semischematic elevational view in part in section of a number of the essential and auxiliary elements of apparatus for carrying out the present invention. Referring now, first, to FIGS. 1 and 2, there are a number of processing stations and mechanisms and these are described starting at the top.

A vertical motion control apparatus 10 is shown schematically. It includes a box 12 mounted to a vertical support 14 and containing a motor or other mechanism adapted to impart rotary motion to the screw member 16. An ingot support station 20 comprises a bar 22 threadedly engaged at one end to the screw member 16 and supporting the ingot 24 at the other end by conventional bolt means 26.

An electroslag refining station 30 comprises a water cooled reservoir 32 containing a molten slag 34 an excess of which is illustrated as the solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and it includes a water cooled hearth 42 containing a skull 44 of solidified refined metal and also a body 46 of liquid refined metal. Water cooled reservoir 32 may be formed integrally with water cooled hearth.

The bottom opening structure 80 of the crucible is provided in the form of a cold finger orifice or alternative form of which is described more fully with reference to FIGS. 3 and 4 below. An optional atomization station 50 is provided immediately below the cold hearth station 40 and cold finger orifice. This station has a gas orifice and manifold 52 which generates streams of gas 54. These streams impact on a stream of liquid metal 56 exiting from cold finger structure 80 to produce a spray 58 of molten metal.

The lowest station 60 is a spray collection station which has a solid receiving surface such as that on the ingot 62 or of other preforms, such as billet or rotary disk preforms. The spray forming may be carried out in an inert atmosphere enclosure indicated schematically by the dashed lined box 71. Such enclosures prevent contamination of the spray with nitrogen or oxygen. The ingot is supported by a bar 64 mounted for rotary movement on motor 66 which, in turn, is mounted to a reciprocating mechanism 68 mounted, in turn, on a structural support 72. The spray forming may use the scanning technique as described in copending application Ser. No. 07/753,497, filed Sep. 3, 1991.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

Referring now more specifically to FIG. 2, this figure is a more detailed view of stations 30, and 40 of FIG. 1. In general, the reference numerals as used in FIG. 2 correspond to the reference numerals as used in FIG. 1 so that like parts bearing the same reference numeral have essentially the same construction and function as is described with reference to FIG. 1.

Similarly, the same reference numerals are used with respect to the same parts in the still more detailed view of FIGS. 3 and 4 discussed more thoroughly below.

As indicated above, FIG. 2 illustrates in greater detail the electroslag refining vessel, the cold hearth vessel, and the various apparatus associated with this vessel.

As indicated by the figure, the station 30 is an electroslag refining station disposed in the upper portion 32 of the vessel and the cold hearth station 40 is disposed in the lower portion 42 of the vessel. The vessel is a double walled vessel having an inner wall 82 and an outer wall 84. Between these two walls, a cooling liquid such as water is provided as is conventional practice with some cold hearth apparatus. The cooling water 86 may be flowed to and through the flow channel between the inner wall 82 and outer wall 84 from supply means and through conventional inlet and outlet means which are conventional and which are not illustrated in the figures. The use of cooling water, such as 86, to provide cooling of the walls of the cold hearth station 40 is necessary in order to provide cooling at the inner wall 82 and thereby to cause the skull 44 to form on the inner surface of the cold hearth structure. The cooling water 86 is not essential to the operation of the electroslag refining or to the upper portion of the electroslag refining station 30 but such cooling may be provided to insure that the liquid metal 46 will not make contact with the inner wall 82 of the containment structure because the liquid metal 46 could attack the wall 82 and cause some dissolution therefrom to contaminate the liquid metal of body 46 within the cold hearth station 40.

In FIG. 2, a structural outer wall 88 is also illustrated. Such an outer wall may be made up of a number of flanged tubular sections. Two such sections 90 and 92 are illustrated in the bottom portion of FIG. 2.

Figure 4:
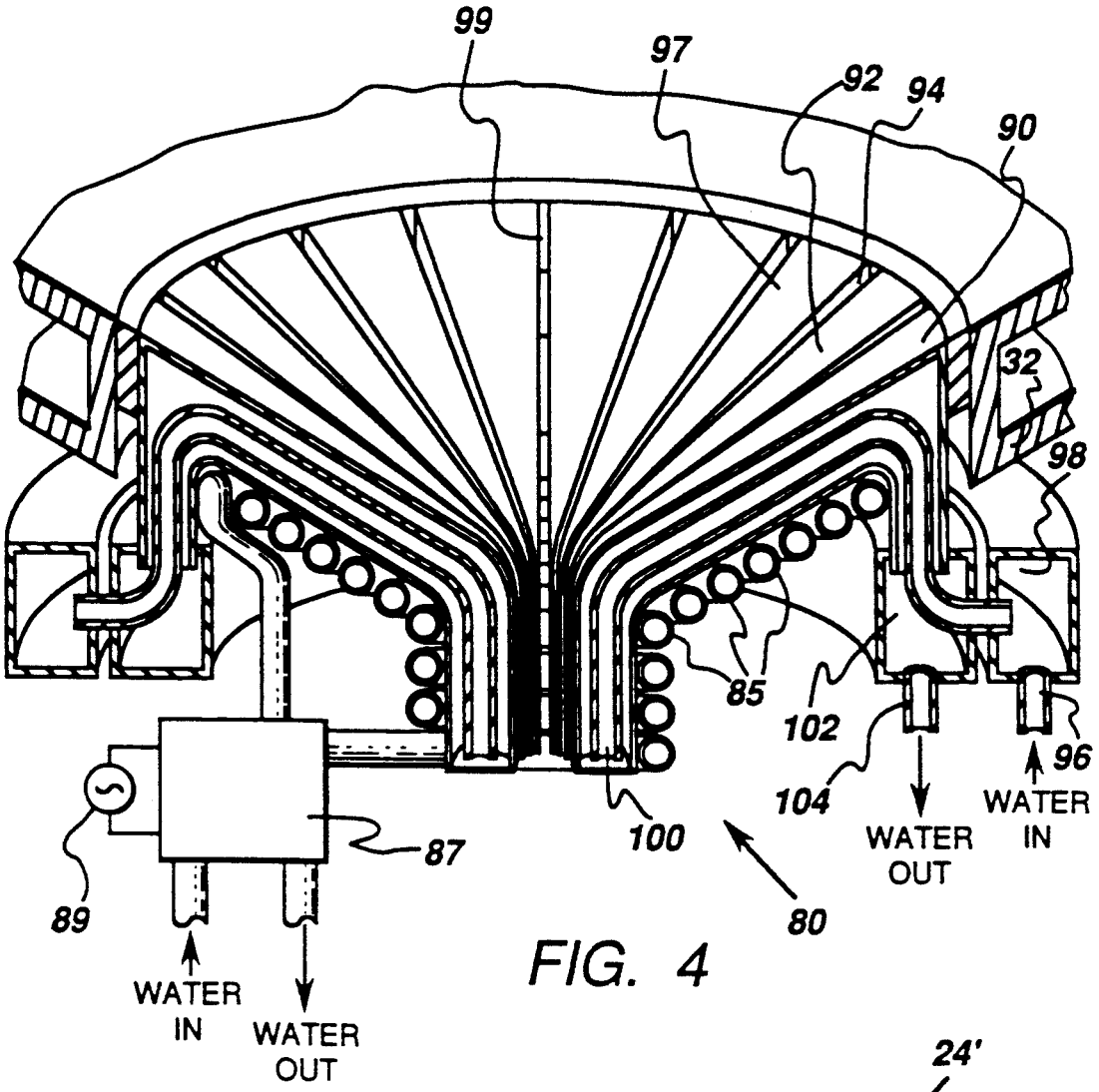
FIG. 4 is a semischematic illustration in part in section of an alternative form of a cold finger nozzle portion of an apparatus as illustrated in FIG. 3 but showing the apparatus free of molten metal.
Figure 3:
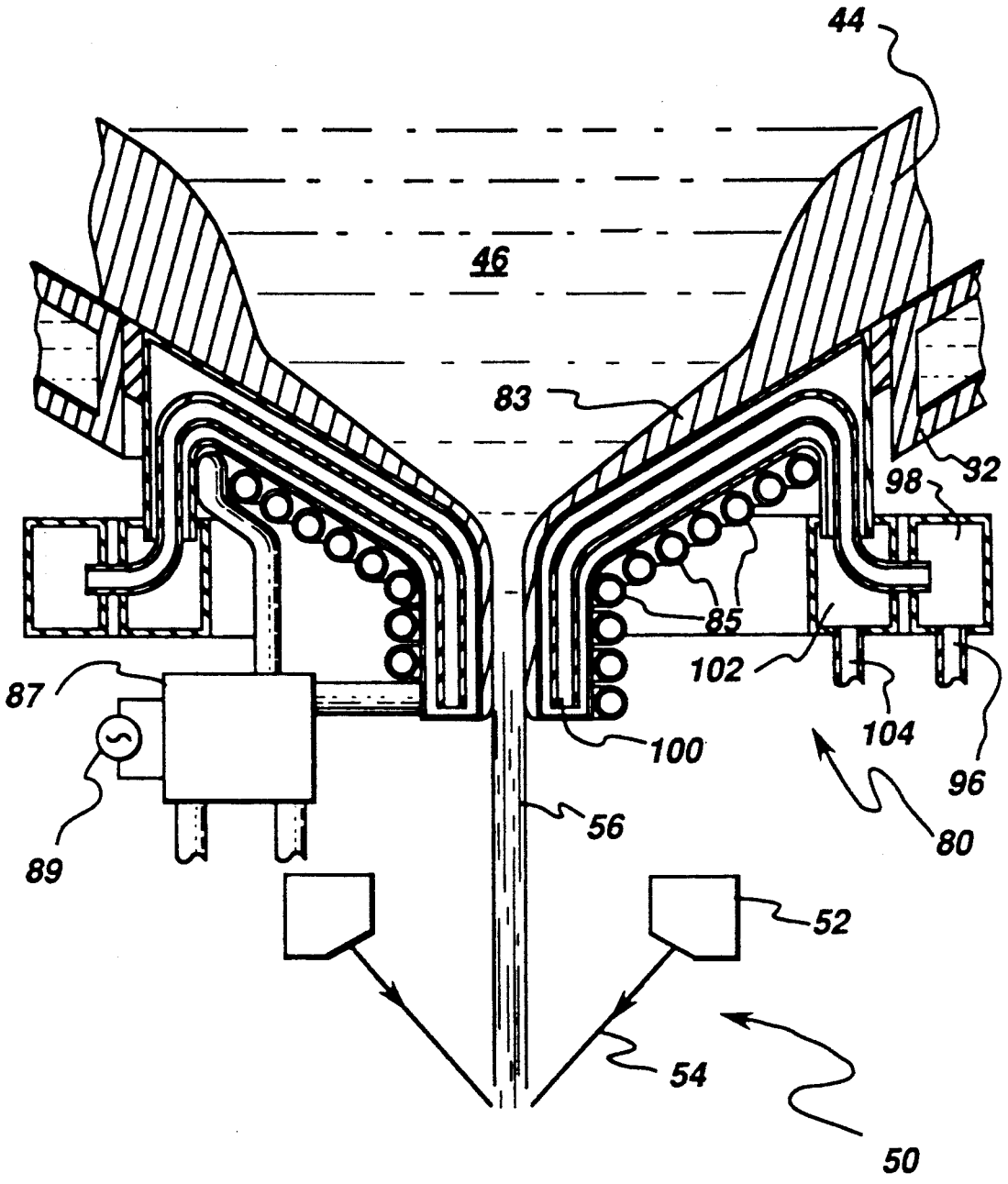
FIG. 3 is a semischematic vertical section in greater detail of one form of a cold finger nozzle portion usable in connection with the structure of FIG. 2.

An alternative form of the cold finger structure 80 is shown in greater detail in FIG. 3 and 4 than it is in FIG. 1. However, rather than trying to describe the structure relative to FIG. 1, reference is made to FIGS. 3 and 4 in which the cold finger structure is shown in greater detail.

Referring now, particularly to FIGS. 3 and 4, the cold finger structure is shown in detail in FIG. 3 in its relation to the processing of the metal from the cold hearth structure and the delivery of a stream 56 of liquid melt 46 from the cold hearth station 40 as illustrated in FIGS. 1 and 2. The illustration of FIG. 3 shows the cold finger structure with the solid metal skull and with the liquid metal reservoir in place. By contrast, FIG. 4 illustrates the cold finger structure without the liquid metal or solid metal skull in order that more structural details may be provided and clarity of illustration may be gained in this way.

Cold finger structures of a general character are not themselves novel structures but have been described in the literature. The Duriron Company, Inc., of Dayton, Ohio, has published a paper in the *Journal of Metals" in September* 1986 entitled "Induction Skull Melting of Titanium and Other Reactive Alloys", by D. J. Chronister, S. W. Scott, D. R. Stickle, D. Eylon, and F. H. Froes. In this paper, an induction melting crucible for reactive alloys is described and discussed. In this sense, it may be said that through the Duriron Company a ceramicless melt system is available. Such a system is also available from Leybold Technologies of Enfield, Conn.

As the Duriron Company article acknowledges, their scheme for melting metal is limited by the volume capacity of their segmented melt vessel. Periodic charging of their vessel with stock to be melted is necessary. It has been found that a need exists for continuous streams of molten metal which goes beyond the limited capacity of vessels such as that taught by the Duriron article. In copending application Ser. No. 07/732,893, filed Jul. 19, 1991, a description is given of a cold finger crucible having a bottom pour spout. The information in that application is incorporated herein by reference.

We have devised a different structure than that disclosed in either the Duriron Company article or in copending application Ser. No. 07/732,893. This structure combines a cold hearth with a cold finger orifice so that the cold finger structure effectively forms part, and in the illustration of FIGS. 2 and 3 the center lower part, of the cold hearth. In making this combination, the advantages of the cold hearth mechanism which permits the purified alloy to form a skull by its contact with the cold hearth and thereby to serve as a container for the molten version of the same purified alloy has been preserved. In addition, the cold finger orifice structure 80 provides a more controllable skull 83 and particularly of a smaller thickness on the inside surface of the cold finger structure. As is evident from FIG. 3, the thicker skull 44 in contact with the cold hearth and the thinner skull 83 in contact with the cold finger structure are essentially continuous.

One reason why the skull 83 is thinner than 44 is that a controlled amount of heat may be put into the skull 83 and into the liquid metal body 46 which is proximate the skull 83 by means of the induction heating coils 185. The induction heating coil 185 is water cooled by flow of a cooling water through the coolant and power supply 187. Induction heating power supplied to the unit 187 from a power source 189 is shown schematically in FIG. 3. One significant advantage of the cold finger construction of the structure 180 is that the heating effect of the induction energy penetrates through the cold finger structure and acts on the body of liquid metal 46 as well as on the skull structure 83 to apply heat thereto. This is one of the features of the cold finger structure and it depends on each of the fingers of the structure being insulated from the adjoining fingers by an air or gas gap or by an insulating material. This arrangement is shown in clearer view in FIG. 4 where both the skull and the body of molten metal is omitted from the drawing for clarity of illustration. Also, a single coil induction mechanism 85 is shown in FIG. 4 rather than the two coil structure (135 and 185) of FIG. 3.

An individual cold finger 97 in FIG. 4 is separated from the adjoining finger 92 by a gap 94 which gap may be provided with and filled with an insulating material such as a ceramic material or with an insulating gas. The molten metal held within the cold finger structure 80 of FIG. 4 does not leak out of the structure through the gaps such as 94 because the skull 82, as illustrated in FIG. 3, forms a bridge over the various cold fingers and prevents and avoids passage of liquid metal therethrough. As is evident from FIG. 4, all gaps extend down to the bottom of the cold finger structure. This is evident in FIG. 4 as gap 99 aligned with the line of sight of the viewer is seen to extend all the way to the bottom of cold finger structure 80. The actual gaps can be quite small and of the order of 20 to 50 mils so long as they provide good insulating separation of the fingers.

As illustrated in FIG. 3, because it is possible to control the amount of heating and cooling passing from the induction coils 135 and 185 to and through the cold finger structure 180, it is possible to adjust the amount of heating or cooling which is provided through the cold finger structure both to the skull 83 as well as to the body 46 of molten metal in contact with the skull.

Referring now again to FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is essentially the same for all of the fingers of the structure so that the cooling of the structure as a whole is achieved by passing water in through inlet pipe 96 and out through outlet pipe 104.

The net result of this action is seen best with reference to FIG. 3 where a stream 156 of molten metal is shown exiting from the cold finger orifice structure 180. This flow is maintained when a desirable balance is achieved between the input of cooling water and the input of heating electric power to and through the induction heating coil 185 of structure 180.

In operation, the apparatus of the present invention may best be described with reference first, now, again to FIG. 1.

One feature of the invention is illustratively shown in FIG. 1. This feature concerns the throughput capacity of the apparatus. As is indicated, the ingot 24 of unrefined metal may be processed in a single pass through the electroslag refining and related apparatus and through the atomization station of 50 to form a relatively large volume ingot 62 through the spray forming processing. Very substantial volumes of metal can be processed through the apparatus because the starting ingot 24 which may have a diameter of 12 to 20 inches may have relatively small concentrations of impurities such as oxide, sulfides, nitrides and the like, which are to be removed by our inert gas assisted electroslag refining process. The ingot 62 formed by the processing as illustrated in FIG. 1 is a refined ingot and has greatly reduced or no oxide, sulfide, nitride and other impurities which are removed by the inert gas assisted electroslag refining of station 30 of the apparatus of FIG. 1. It is, of course, possible to process a single relatively large scale ingot through the apparatus and to weld the top of ingot 24 to the bottom of a superposed ingot to extend the processing of ingots through the apparatus of FIG. 1 to several successive ingots.

While the processing as illustrated in FIG. 1 deals with the spray forming of ingot 62, it will be realized that the atomization station 50 may be employed simply to produce atomized metal. In this case, no ingot 62 is formed but rather the product of the processing is the formation of powder which may be employed in conventional powder metallurgy processing to form finished articles through well-known established practice. Such a formation of powder is illustrated with reference to FIG. 2.

Depending on the application to be made of the electroslag refining apparatus as illustrated in FIG. 1, there is established a need to control the rate at which a metal stream such as 56 is removed from the cold finger orifice structure 80.

Figure 5:
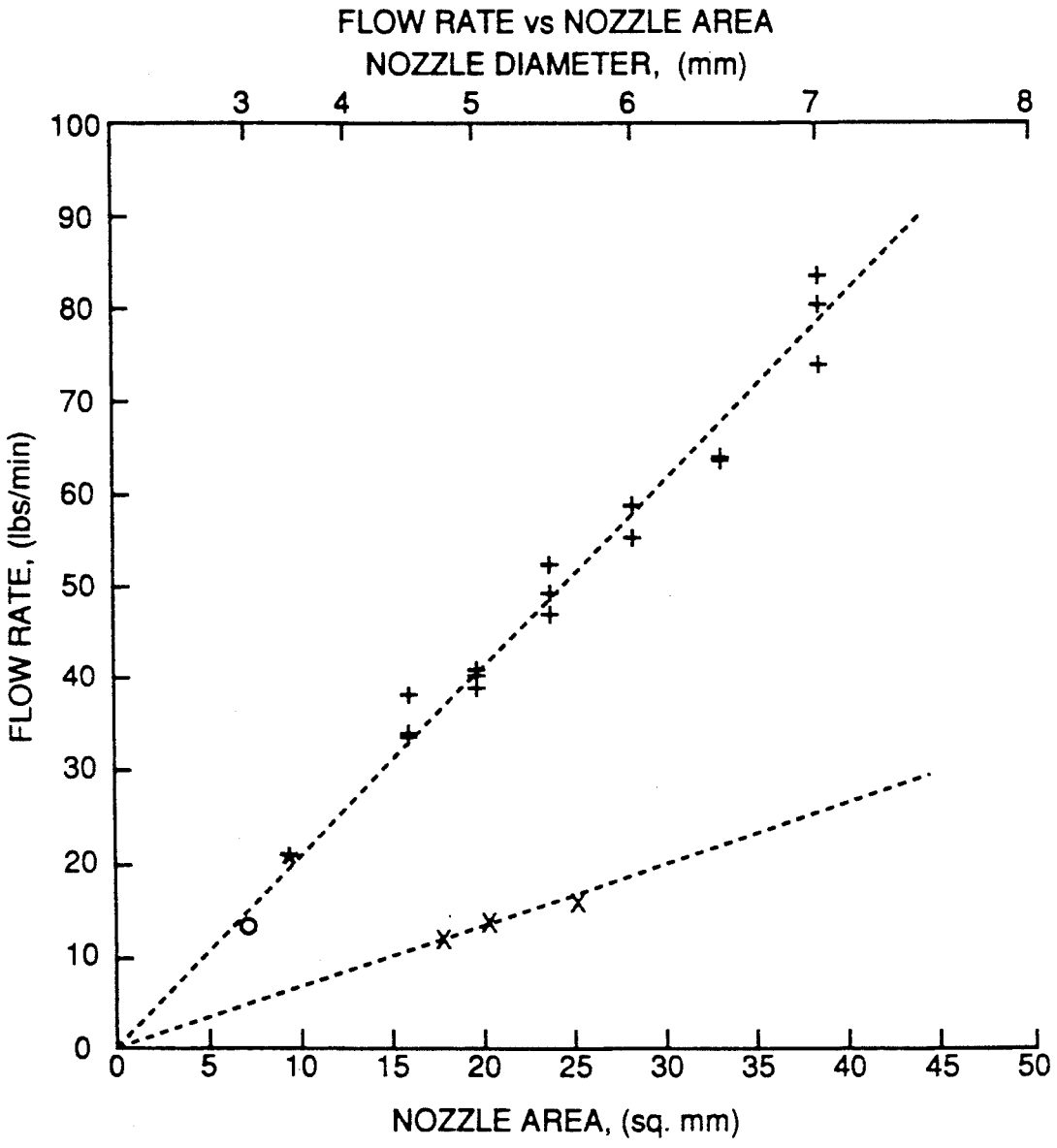
FIG. 5 is a graph in which flow rate in pounds per minute is plotted against the area of the nozzle opening in square millimeters for two different heads of molten metal and specifically a lower plot for a head of about 2 inches and an upper plot for a head of about 10 inches of molten metal.

The rate at which such a stream of molten metal may be drained from the cold hearth through the cold finger structure 80 is controlled by the cross-sectional area of the orifice and by the hydrostatic head of liquid above the orifice. This hydrostatic head is the result of the column of liquid metal and of liquid salt which extends above the orifice of the cold finger structure 80. The flow rate of liquid from the cold finger orifice or nozzle has been determined experimentally for a cylindrical orifice. This relationship is shown in FIG. 5 for two different hydrostatic head heights. The lower plot defined by X's is for a two inch head of molten metal and the upper plot defined by +'s and o's is for a 10 inch head of molten metal. In this figure, the flow rate of metal from the cold finger nozzle is given on the ordinate in pounds per minute. Two abscissa are shown in the figure—the lower is the nozzle area in square millimeters and the upper ordinate is the nozzle diameter in millimeters. Based on the data plotted in this figure, it may be seen that for a nozzle area of 30 square millimeters, the flow rate in pounds per minute was found to be approximately 60 pounds per minute for the 10 inch hydrostatic head. For the 2 inch hydrostatic head, this nozzle area of 30 square millimeters gave the flow rate of approximately 20 pounds per minute.

What is made apparent from this experiment is that if a electroslag refining apparatus, such as that illustrated in FIG. 2, is operated with a given hydrostatic head, that a nozzle area can be selected and provided which permits an essentially constant rate of flow of liquid metal from the refining vessel so long as the hydrostatic head above the nozzle is maintained essentially constant. It is deemed to be important in the operation of such an apparatus to establish and maintain an essentially constant hydrostatic head. To provide such a constant hydrostatic head, it is important that the electroslag refining current flowing through the refining vessel be such that the rate of melting of metal from the ingot such as 24 be adjusted to provide a rate of melting of ingot metal which corresponds to the rate of withdrawal of metal in stream 56 from the refining vessel.

In other words, one control on the rate at which the metal from ingot 24 is refined in the apparatus of FIG. 1 is determined by the level of refining power supplied to the vessel from a source such as 74 of FIG. 1. Such a current may be adjusted to values between about 2,000 and 20,000 amperes. A primary control, therefore, in adjusting the rate of ingot melting and, accordingly, the rate of introduction of metal into the refining vessel is the level of power supply to the vessel. In general, a steady state is desired in which the rate of metal melted and entering the refining station 30 as a liquid is equal to the rate at which liquid metal is removed as a stream 56 through the cold finger structure. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten salt 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40, which is described in the background statement above as a problem in the conventional electrorefining processing, is found to be an advantage in the electroslag refining of the subject invention.

One feature which is provided pursuant to the present invention in carrying out the electroslag refining of an ingot 24 as described above is the processing of the refinement under conditions which tend to minimize the presence of nitrogen in the refined metal product of the processing period. With reference now particularly to FIG. 1, an apparatus which can be employed in reducing or minimizing presence of nitrogen in the refined titanium or zirconium product of the processing is now described.

At least one passage way, such as 23, is formed in the ingot 24 to permit an inert gas to be passed down and through the ingot and into the slag 34. Bubbles 33 of such an inert gas are illustrated in FIG. 1 and evidence the path which the gas passing down through passage way 23 would take once the gas has entered the molten slag 34. The inert gas bubbles emerge from the molten bath and pass into the housing cover 31 mounted over the tank wall 32. The housing cover is adapted to receive gas bubbling up from the slag 33 as well as gas entering the upper portion of the housing 31 through the pipe 35. The inert gas, such as helium or argon, entering housing 31 from pipe 35 has a very low content, or partial pressure of nitrogen because it emerges from the inert gas circulating and gettering unit 37.

Unit 37 contains conventional pumping means by which the gettered gas is circulated through pipe 35. In addition, unit 37 contains a gettering means to remove nitrogen and other impurities in the inert gas entering unit 37 through the pipe 29. Such a gettering unit is a body of metal, such as titanium, preferably in a sponge or powdered state, and having a large surface area. The getter having the high surface area is heated to a temperature above 700° C. while it is serving as a getter.

The inert gas passing into unit 37 from pipe 29 passes into contact with the large exposed surface of the gettering metal and nitrogen and other impurities in the inert gas react to a large degree with the heated gettering metal so as to getter the nitrogen out of the inert gas. A first portion of the gettered inert gas is passed back to the housing 31 through pipe 35. Another portion of the gettered inert gas is passed up through the pump and flow control means 39 and pipe 41 to pass into the passage way 23 in the electrode 24 through the pipe 43. A section of flexible pipe 45 permits the pipe 43 to move with the electrode 24 as the electrode is gradually consumed by the electroslag refining process and descends toward the slag molten slag 34.

One result of the circulation of the inert gas, such as helium or argon, through the apparatus and particularly the heated gettering unit 37 is that a inert gas having a very low partial pressure or no partial pressure of nitrogen is continuously passed into contact with the lower portion of the electrode as well as into contact with the upper surface of the molten slag and, in addition, is passed into and through the molten slag in the region where the electroslag refining is in progress and in this way nitrogen, which is present in the unrefined metal of the ingot 24, is removed from the slag and from the refined metal body 46, which forms beneath this slag of bath 34.

It should be appreciated in carrying out the process of the present invention that substantial benefit is obtained by passing a gettered inert gas past and over the molten slag 34. This accomplished by circulating gas through pipe 35 and housing 31 and returning it to the gettering and pump unit 37 through pipe 29. This protective covering for the slag 34 is beneficial in that the partial pressure of nitrogen in the inert gas of the slag is very low because of the effect of gettering action in unit 37.

In addition, a degree of efficiency and advantages added by having gas passed down through the electrode 24 and into the molten slag 34 in the manner illustrated in FIG. 1. One advantage is that the inert gas is delivered to the molten slag at the very point where the melting of the ingot 24 takes place and residual volatile impurities, such as nitrogen, are released. Further, the gettered inert gas passing down through passageway 23 of ingot 24 has the advantage of being present in the slag precisely where the refining of the molten metal droplets takes place and where any volatile impurities which are released from such refining action can be carried by the inert gas from the slag and to the housing 31 for return to the getter in unit 37 and absorption on the getter therein.

Figure 1A:
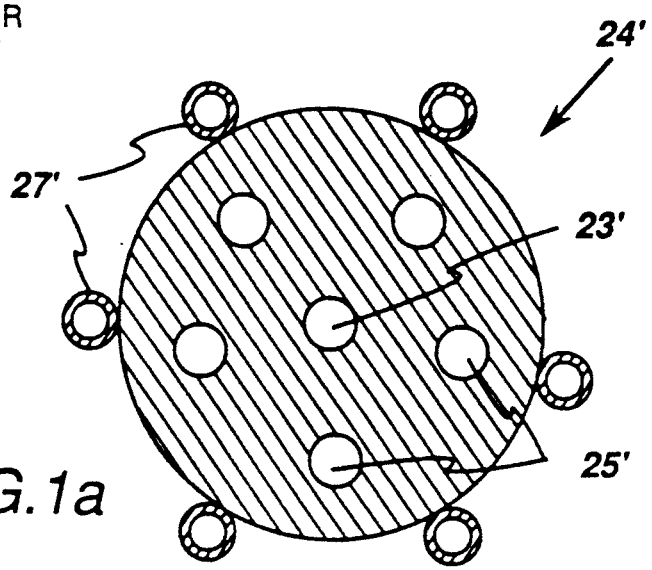
FIG. 1*a* is a sectional view of an electrode similar to electrode 24 of FIG. 1.

Referring now next to FIG. 1*a*, this figure provides a sectional view of an electrode or ingot 24' similar to the ingot 24 of FIG. 1. Such an alternative ingot is designed for use in an apparatus such as that illustrated in FIG. 1 and is a an ingot of the metal to be refined by the electroslag refining process. As is evident from the figure there is a central passageway 23' formed in the ingot similar to the passageway 23 of FIG. 1. In addition there is a ring of alternative passageways 25' in the ingot to permit a greater distribution of gettered inert gas to and through the molten slag 34 of the apparatus of FIG. 1. Moreover there is illustrated in FIG. 1*a* a ring of pipes welded or otherwise mounted to the exterior of the ingot 23'. These pipes may be formed of the same metal as that of the ingot 23' and they are mounted to the ingot to serve the same purpose as the passageways such as 23' or 25' through the body of the ingot. This purpose is to provide a path for flowing gettered inert gas from a unit such as 37 to the slag melt. Conventional hook up of gas supply means such as the supply pipe 43 of FIG. 1 is provided for use of these alternative passages for the gettered inert gas from unit 37. One advantage of the use of extermanly mounted pipes is that the cost of forming and mounting pipes is less than the cost of forming holes such as 23 or 23' or 25' in an elongated solid ingot of titanium or zirconium. The pipes also permit a wider distribution of the gettered inert gas into the molten slag bath 34.

What is claimed is:

1. Apparatus for producing refined titanium base alloy containing a low concentration of nitrogen which comprises:

electroslag refining apparatus comprising a refining vessel adapted to receive and to hold a molten slag, a body of molten slag in said vessel adapted to the electroslag refining of titanium base metal, means for positioning an ingot of a titanium base alloy as an electrode in said vessel in touching contact with said molten slag, electric supply means adapted to supply refining current to said ingot electrode and through said molten slag to a body of refined metal beneath said slag to keep said refining slag molten and to melt the end of said ingot electrode which is in contact with said slag, means for maintaining a low partial pressure of nitrogen in contact with the surface of said molten slag and in contact with the portion of said ingot electrode in contact with said slag, means for advancing said ingot electrode toward and into contact with said molten slag at a rate corresponding to the rate at which the contacted surface of said ingot electrode is melted as the refining thereof proceeds, a cold hearth vessel beneath said electroslag refining apparatus, said cold hearth being adapted to receive and to hold electroslag refined molten titanium base alloy in contact with a solid skull of said refined alloy formed on the walls of said cold hearth vessel, a body of refined molten titanium base alloy in said vessel beneath said body of molten slag, a cold finger apparatus below said cold hearth adapted to receive and to dispense as a stream refined molten titanium base alloy processed through said electroslag refining process and through said cold hearth, said cold finger apparatus having a bottom pour orifice, a skull of solidified refined titanium base alloy in contact with said cold hearth and said cold finger apparatus including said bottom pour orifice, and means for converting the stream of molten metal passing from said bottom pour orifice into an article of refined titanium base alloy having a low concentration of nitrogen.

2. The apparatus of claim 1, in which the refining vessel is a water cooled metal vessel.

3. The apparatus of claim 1, in which the electric supply means is adapted to supply between about two thousand to twenty thousand amperes of refining current.

4. The apparatus of claim 1, in which the article is a body of titanium base powder.

5. The apparatus of claim 1, in which the means for converting is spray forming means.

6. The apparatus of claim 1, in which the means for converting is an atomizing means.

7. The apparatus of claim 1, in which the means for maintaining a low partial pressure is a means for maintaining a zero nitrogen partial pressure.

8. The apparatus of claim 1, in which the means for converting is a continuous rod casting means.

9. The apparatus of claim 1, in which the means for converting is a melt spinning means.

10. The apparatus of claim 1, in which the means for advancing said ingot is adapted to advance the ingot to be refined at the rate corresponding to the rate at which the refined molten titanium base alloy is dispensed from said cold hearth.

11. The apparatus of claim 1, in which the electroslag refining apparatus and the cold hearth are in the upper and lower portion of a single metal double walled vessel having cooling water flowing between the double walls of said vessel.

12. Apparatus for producing low nitrogen titanium base alloy powder which comprises:

electroslag refining apparatus comprising a refining vessel adapted to receive and to hold a metal refining molten slag adapted to the electroslag refining of titanium base alloy, means for positioning an ingot electrode in said vessel in touching contact with said molten slag, means for maintaining a low partial pressure of nitrogen in contact with the surface of said molten slag and in contact with the portion of said electrode in contact with said slag, electric supply means adapted to supply refining current to said electrode and through said ingot and molten slag to a body of refined titanium base alloy beneath said slag to keep said refining slag molten and to refine the alloy of said ingot, means for advancing said ingot electrode toward said molten slag at a rate corresponding to the rate at which the electrode is consumed as the refining thereof proceeds, a cold hearth beneath said metal refining vessel, said cold hearth being adapted to receive and to hold electroslag refined, molten, low nitrogen titanium base alloy in contact with a solid skull of said refined alloy formed on the walls of said cold hearth, a cold finger orifice below said cold hearth, said cold finger orifice being adapted to receive and to dispense as a stream molten alloy processed through said electroslag refining process and through said cold hearth, and means for atomizing the stream of molten titanium base alloy passing from said cold finger orifice.

13. The apparatus of claim 12, in which the refining vessel is a water cooled metal vessel.

14. The apparatus of claim 12, in which the electric supply means is adapted to supply between about two thousand to twenty thousand amperes of refining current.

15. The apparatus of claim 12, in which the means for advancing said ingot is adapted to advance the ingot to be refined at the rate corresponding to the rate at which the refined molten titanium base alloy is dispensed from said cold hearth.

16. The apparatus of claim 12, in which the electroslag refining apparatus and the cold hearth are in the upper and lower portion of a single metal vessel having double walled construction and having cooling means disposed between the double walls of said vessel.

* * * * *

UNITED STATES PATENT AND TRADEMARK OFFICE

CERTIFICATE OF CORRECTION

PATENT NO. : 5,332,197

DATED : July 26, 1994

INVENTOR(S) : Mark G. Benz, et al

It is certified that error appears in the above-indentified patent and that said Letters Patent is hereby corrected as shown below:

On the title page: Item [54] and Column 1, line 1,

Delete "OR" and substitute --OF--.

The title should now read "ELECTROSLAG REFINING OF TITANIUM TO ACHIEVE LOW NITROGEN".

Signed and Sealed this

Twenty-seventh Day of September, 1994

*Attest:*

Bruce Lehman

BRUCE LEHMAN

*Attesting Officer*

*Commissioner of Patents and Trademarks*